US005252531A

United States Patent [19]

Yasuda et al.

[11] Patent Number: 5,252,531

[45] Date of Patent: * Oct. 12, 1993

[54] THERMAL TRANSFER IMAGE-RECEIVING SHEET

[75] Inventors: Kenji Yasuda, Yachiyo; Toshihiro Minato; Masaru Kato, both of Tokyo, all of Japan

[73] Assignee: Oji Paper Co., Ltd., Tokyo, Japan

[ * ] Notice: The portion of the term of this patent subsequent to Nov. 20, 2007 has been disclaimed.

[21] Appl. No.: 683,160

[22] Filed: Apr. 10, 1991

[30] Foreign Application Priority Data

Apr. 11, 1990 [JP] Japan ..... 2-93923

[51] Int. Cl.[5] ..... B41M 5/035; B41M 5/38

[52] U.S. Cl. ..... 503/227; 428/195; 428/207; 428/211; 428/213; 428/216; 428/317.9; 428/318.4; 428/328; 428/330; 428/331; 428/513; 428/516; 428/523; 428/910; 428/913; 428/914

[58] Field of Search ..... 8/471; 428/195, 211, 428/332, 334–336, 513, 516, 523, 910, 913, 914, 207, 212, 213, 215, 216, 317.9, 318.4, 328, 330, 331; 503/227

[56] References Cited

U.S. PATENT DOCUMENTS 4,971,950 11/1990 Kato et al. ..... 503/227

*Primary Examiner*—B. Hamilton Hess

*Attorney, Agent, or Firm*—Armstrong, Westerman, Hattori, McLeland & Naughton

[57] ABSTRACT

A thermal transfer image-receiving sheet capable of receiving clear, uniform colored images without a formation of curls and wrinkles therein, comprising (A) a substrate sheet comprising (a) a core sheet with a thickness of 10 to 300 μm, and (b) at least one polyolefin resin coating layer formed on at least a front surface of the core sheet and having a porosity of 33% or more and a thickness of 20 μm or more and (B) at least one image-receiving resinous layer formed on at least the front resinous coating layer and having a thickness of 10 μm or less.

14 Claims, 1 Drawing Sheet

THERMAL TRANSFER IMAGE-RECEIVING SHEET

BACKGROUND OF THE INVENTION

1) Field of the Invention

The present invention relates to a thermal transfer image-receiving sheet. More particularly, the present invention relates to a thermal transfer image-receiving sheet capable of receiving and fixing thereon thermally transferred dye or ink images or pictures in a clear and sharp form without a thermal curling thereof, to record thereon continuous tone full-colored images or pictures at a high resolution and a high tone reproductivity, and capable of being smoothly moved through a thermal printer without fear of jamming.

2) Description of the Related Arts

Currently there is enormous interest in the development of new types of color printers capable of recording clear full color images or pictures, for example, relatively compact thermal printing systems, especially sublimating dye thermal transfer printers.

The small sized thermal dye transfer full color printers are expected to be widely utilized as printers for electronic camera and video printers.

In the dye thermal transfer printer, colored images or pictures are formed by superimposing a dye ink sheet composed of a substrate sheet and a dye ink layer formed on the substrate sheet and comprising a mixture of a sublimating dye with a binder on a dye image-receiving sheet composed of a dye image-receiving resinous layer formed on a substrate sheet in such a manner that the ink layer surface of the ink sheet is brought into direct contact with the dye image-receiving resinous layer of the dye image-receiving sheet, and the dye ink layer is partly heated by thermal heat of a printer in accordance with an input of electric signals corresponding to the images or pictures to be printed, to thermally transfer the dye images or pictures to the dye image-receiving resinous layer.

It is known that a dye image-receiving sheet composed of a substrate sheet consisting of a biaxially oriented film comprising a mixture of a polyolefin resin with an inorganic pigment or a synthetic resin paper-like sheet, and a dye image-receiving layer comprising a dye-receiving polymeric material, for example, a polyester resin, polycarbonate resin or acrylic resin, is useful for recording thereon clear dye images, using the thermal printer as mentioned above. The above-mentioned film or sheet has a uniform thickness, a high flexibility and a low thermal conductivity, compared with that of a wood pulp paper sheet, and therefore, is advantageous in that thermally transferred colored images thereon have an uniform image quality and a high color density.

Nevertheless, when dye images are thermally transferred to a dye image-receiving sheet having a substrate sheet composed of a biaxially oriented polyolefin film, the color density and uniformity of the resultant dye images are sometimes uneven, depending on the type of the substrate sheet, and therefore, the commercial value of the dye-image receiving sheet is not always constant. Namely, some dye image-receiving sheets are unsatisfactory in that a formation of uneven images and an insufficient sensitivity thereof occur due to an influence of the pigment.

Generally, the biaxially oriented sheet composed of a multi-layered polyolefin resin film containing an inorganic pigment has a uniform quality and exhibits a satisfactory conformity to the thermal head of the printer. Nevertheless, this type of synthetic resin paper-like sheet contains a relatively large amount of the inorganic pigment, and has a paper-like surface layer formed by a drawing operation, and having a number of voids. The paper-like surface layer has a relatively high roughness, and therefore, it is difficult to attain a high resolving power on the order of 10 μm or less when using the above-mentioned conventional type of the synthetic paper sheet.

It is possible to increase the resolution and the reproductibility of the images to a certain extent, by increasing the pressure between a platen roll and a thermal head, but when this pressure of the platen roll becomes too high, the accuracy of the transferred images is lowered.

Also, due to a relatively high rigidity of the polyolefin resin in the synthetic paper sheet, there is a limitation of the degree of close contact of the image receiving sheet with the printing thermal head. Therefore, an improvement of the substrate sheet to enhance the quality of the thermally transferred dye images is strongly demanded.

Accordingly, the present invention intends to provide a substrate sheet from which a dye image-receiving sheet free from the above-mentioned disadvantages can be obtained.

Also, it is known that, in the dye thermal transfer image printer, a large amount of heat energy is imparted to the dye image receiving sheet, which causes an undesirable thermal shrinkage, curling and wrinkling of the image receiving sheet.

Where an oriented polymeric film is laminated and bonded to a core sheet having a small thermal shrinkage, the resultant dye image-receiving sheet exhibits a reduced thermal curling property in a thermal printing process, but, this type of core sheet is not satisfactory when trying to obtain a dye image-receiving sheet having a smooth movability in the thermal printer and capable of displaying high quality colored image thereon.

In a conventional dye image-receiving sheet, a dye image receiving resinous layer is formed on a substrate sheet. This dye image-receiving resinous layer usually comprises a resinous material, for example, saturated polyester resin, capable of being dyed with sublimating dyes.

Japanese Unexamined Patent Publication No. 58-215,398 discloses that the saturated polyester resin in the dye image-receiving layer is cross-linked with a cross-linking compound, for example, isocyanate compounds, to prevent a thermal melt-adhesion of the dye image-receiving layer with a dye ink layer of a dye ink sheet when a thermal transfer of the dye images is carried out from the dye ink layer to the image receiving layer by heat from a thermal head. When the cross-linking agent is added, the resultant dye image-receiving saturated polyester resin layer exhibits an increased thermal shrinkage depending on the type and the amount of the added cross-linking agent, and therefore when heated, the resultant dye image-receiving sheet is thermally curled in such a manner that the dye image-receiving resinous layer becomes an inside layer thereof.

The curling of the image-receiving sheets causes the travel of the sheets in the printer to be obstructed, and sometimes makes a delivery of the sheets from the printer impossible. Also, the quality of the printed colored images becomes poor.

SUMMARY OF THE INVENTION

An object of the present invention is to provide a thermal transfer image-receiving sheet usable for recording thereon sublimating dye images or ink images with an excellent clarity and at a high reproductivity, without a thermal deformation or curling of the sheet.

Another object of the present invention is to provide a thermal transfer image-receiving sheet for recording thereon sublimating dye images or ink images with a uniform quality and a continuous tone color density by a thermal printer in which a large amount of heat is applied to the sheet through a thermal head.

The above-mentioned objects can be attained by the thermal transfer image-receiving sheet of the present invention, which comprises (A) a substrate sheet comprising (a) a core sheet having a thickness of 10 to 300 μm, and (b) at least one resinous coating layer formed on at least a front surface of the core sheet, comprising as a principal component, a mixture of a polyolefin resin with an inorganic pigment and having a porosity of 33% or more and a thickness of 20 μm or more; and (B) at least one image-receiving layer formed on at least the front resinous coating layer of the substrate sheet, comprising a polymeric material capable of being dyed with dyes and having a thickness of 10 μm or less.

In an embodiment of the present invention, the image-receiving sheet has a Clark rigidity of 75 to 160 and a Young's modulus of $3\times10^{10}$ to $1\times10^{11}$ dyne/cm$^2$ in the longitudinal direction thereof.

In another embodiment of the image-receiving sheet of the present invention, the thickness $D_1$ of the image-receiving layer, the thickness $D_2$ of the resinous coating layer formed on the front surface of the core sheet, the thickness $D_3$ of the core sheet and the thickness $D_4$ of the resinous coating layer formed on a back surface of the core sheet satisfy the relationships ($I_a$), ($I_b$) and ($I_c$):

$$D_2>D_1 \quad (I_a)$$

$$D_3>D_1 \quad (I_b)$$

and $$D_4\geqq D_2 \quad (I_c)$$

and in a thermal shrinking test at a temperature of 100° C. in accordance with JIS K6734, the thermal shrinkage $S_1$ of the image-receiving layer, the thermal shrinkage $S_2$ of the front resinous coating layer, the thermal shrinkage $S_3$ of the core sheet and the thermal shrinkage $S_4$ of the back resinous coating layer satisfy the relationship (II):

$$S_4>S_2\geqq S_3 \quad (II)$$

and preferably the relationships (III*a*) and (III*b*):

$$S_4\cdot D_4>S_1\cdot D_1 \quad (III a)$$

and $$S_4\cdot D_4>S_2\cdot D_2 \quad (III b)$$

DESCRIPTION OF THE PREFERRED EMBODIMENTS

The thermal transfer image receiving sheet of the present invention comprises (A) a substrate sheet comprising (a) a core sheet and (b) at least one resinous coating layer formed on at least a front surface of the core sheet, and (B) at least one image receiving layer formed on at least the front resinous coating layer of the substrate sheet.

Figure 1:
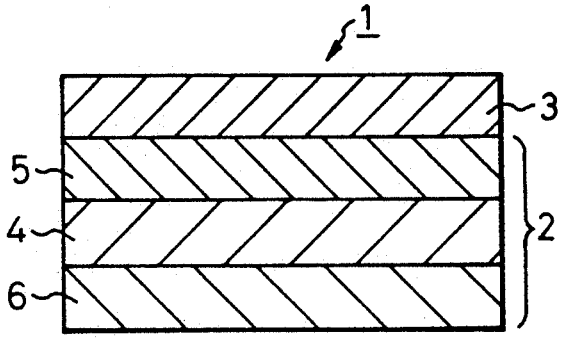
FIG. 1 is an explanatory cross-sectional profile of an embodiment of the thermal transfer image-receiving sheet of the present invention; and, FIG. 2 is an explanatory cross-sectional profile of another embodiment of the thermal transfer image-receiving sheet of the present invention.

For example, as indicated in FIG. 1, a thermal transfer image-receiving sheet 1 is composed of a substrate sheet 2 and an image-receiving resinous layer 3. Substrate sheet 2 is composed of a core sheet 4, a front resinous coating layer 5 formed on the front surface of the core sheet 4, and a back resinous coating layer 6 formed on the back surface of the core sheet 4. The image-receiving resinous layer 3 is formed on the front resinous coating layer 5.

Figure 2:
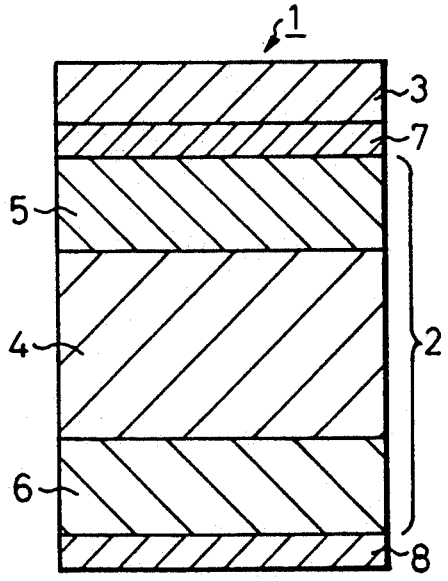

Referring to FIG. 2, an image-receiving sheet 1 has a substrate sheet 2 and an image-receiving resinous layer 3. The substrate sheet 2 is composed of a core sheet 4, a front resinous coating layer 5 formed on a front surface of the core sheet 4, and a back resinous coating layer 6 formed on a back surface of the core sheet 4. The image-receiving resinous layer 3 is adhered to the front resinous coating layer 5 through an adhesive layer 7. Also, the back resinous coating layer 6 is covered by a back resin layer 8.

In the image-receiving sheet of the present invention, the core sheet has a thickness of 10 to 300 μm, which thickness effectively prevents the thermal curling of the resultant image-receiving sheet. When the thickness is less than 10 μm, the resultant image-receiving sheet exhibits a poor resistance to the thermal curling in the printer, and a thickness of more than 300 μm causes the resultant image-receiving sheet to exhibit a very high stiffness and a poor traveling property through the printer.

The core sheet preferably has higher modulus of elasticity and density than those of the resinous coating layers formed thereon, to prevent a curling thereof.

The core sheet usable for the present invention comprises a member selected from woodfree paper sheets, mechanical paper sheets, Japanese paper sheets, thin paper sheets, coated paper sheets, polyester films, polyolefin films polyamide films and composite sheets composed of two or more of the above mentioned sheets and films.

Preferably, the core sheet is composed of a polyethylene terephthalate film.

The coated paper sheet can be prepared by coating at least one surface of a woodfree paper sheet or a mechanical paper sheet with a coating layer comprising a pigment and a binder. The pigment is preferably selected from kaolin, clay, calcium carbonate, aluminum hydroxide, and plastic pigments.

The binder comprises a member selected from water-soluble polymeric materials, for example, starch and water-insoluble polymer emulsion, for example, aqueous emulsions or latexes of styrene polymers and butadiene polymers.

In the image-receiving sheet of the present invention, the front and back resinous coating layers comprise a mixture of a polyolefin resin with an inorganic pigment and have a porosity of 33% or more, preferably 36% or more, still more preferably 36 to 45% and a thickness of 20 μm or more, preferably 30 to 80 μm, and preferably a density of 0.7 or less and an ash content of 30% by weight or more.

The polyolefin resin usable for the resinous coating layer comprises at least one member selected from, for example, high density polyethylene resins, low density polyethylene resins, and polypropylene resins and optionally contains a small amount (10% by weight or less) of an additional thermoplastic resin, for example, polystyrene resins or ethylene-vinyl acetate copolymers.

Preferably, the resinous coating layer comprises 40 to 90% by weight of a polypropylene resin, 5 to 30% by weight of a high density polyethylene resin and 5 to 40% by weight of an inorganic pigment.

The inorganic pigment comprises at least one member selected from, for example, ground and precipitated calcium carbonates, sintered clay, diatomaceous earth, talc, titanium dioxide, silica and aluminum sulfate, each preferably having an average particle size of 20 μm or less.

The resinous coating layer is preferably formed from a synthetic resin paper-like sheet consisting of at least one uniaxially or biaxially oriented, single layered or multilayered polyolefin film containing the inorganic pigment. The multilayered film may be composed of a core or base layer and two paper-like layers consisting of a uniaxially or biaxially oriented film and located on the front and back surfaces of the multilayered film. This film has a three-layer structure. Also, the multilayered film may have a four or more-layered structure and contain one or more additional polyolefin resin layers in addition to the base layer and the two paper-like layers. For example, the additional layers are formed from a polyolefin resin free from the inorganic pigment and arranged on the paper-like layers.

The multilayered structure of the polyolefin film can be formed by laminating at least one biaxially oriented base sheet comprising a polyolefin resin and an inorganic pigment, and at least two paper-like sheets consisting of mono-axially oriented polyolefin films and bonded to the two surfaces of the base sheet, or by laminating at least one base sheet at least two paper-like sheets and at least one additional layer, for example, an additional top-coated sheets, to increase the whiteness of the multilayered composite film.

The oriented polyolefin film has a number of voids or pores distributed therein. The voids or pores are formed when an undrawn polyolefin film containing an inorganic pigment is drawn uniaxially or biaxially. The amount of the voids or pores is variable in response to the drawing conditions and the types and contents of the polyolefin resin and pigment.

The porosity of the porous film can be calculated from the true specific gravities, of the components therein and the apparent density of the film. The porous film may be substantially opaque or almost transparent due to the amount of the voids therein.

The resinous coating layer having a porosity of 33% or more, preferably 36% or more, exhibits a low and uniform thermal conductivity and causes the resultant image-receiving resinous layer formed thereon to exhibit a high imaging sensitivity and to receive clear images thereon. To obtain this low and uniform thermal conductivity, the resinous coating layer must have a thickness of 20 μm or more, preferably 30 to 80 μm.

Also, the resinous coating layer preferably has a low thermal shrinkage, for example, of 0.1% or less at a temperature of 100° C. when determined in accordance with JIS K6734.

The thermal shrinkage of the polyolefin film for the resinous coating layer can be reduced by preliminarily heat-treating at a temperature of 70° C. to 120° C., for example, by bringing the film into contact with a heating roll to release stress created in the film by the drawing operation.

Where a back resinous coating layer is formed on a back surface of the core sheet to prevent the thermal curling of the resultant image-receiving sheet, the thermal shrinkage of the front resinous coating layer is preferably smaller than that of the back resinous coating layer.

In the image-receiving sheet of the present invention, at least one image receiving resinous layer is formed on at least the front resinous coating layer of the substrate sheet (and optionally on the back resinous coating layer of the substrate sheet). The image receiving resinous layer comprises a polymeric material capable of being dyed with dyes, especially sublimating dyes. The polymeric material should have not only a high capability of dissolving and fixing therein a large amount of the dyes, but also a high thermal conductivity.

The image-receiving resinous layer comprises at least one member selected from saturated polyester resins comprising a polymerization product of a saturated dicarboxylic acid component comprising at least one member selected from orthophthalic acid, isophthalic acid, terephthalic acid, adipic acid and sebacic acid, preferably the above-mentioned aromatic dicarboxylic acids, with a polyol component comprising at least one member selected from ethylene glycol, propylene glycol and addition reaction products of bisphenol A with ethylene glycol; epoxy resins, cellulosic resins and polyamides which can be dyed with sublimating dyes.

The image-receiving resinous layer has a thickness of 10 μm or less, preferably 1 to 10 μm.

When the image-receiving sheet has a single image-receiving resinous layer formed on the front resinous coating layer of the substrate sheet, the back surface of the substrate sheet or the core sheet is optionally covered with a plastic resinous film which is effective for enhancing the curl-resistance of the resultant image-receiving sheet. Usually, the back plastic resinous film layer has a thickness of 10 μm or more, and thus has a satisfactory mechanical strength for practical use.

The back plastic resinous film layer may be coated by an additional coating layer comprising, for example, a polyacrylic resin and a polymeric surfactant or a monomeric surfactant.

The front or back resinous coating layer can be formed by a dry laminating method in which an adhesive agent, for example, polyether or polyester adhesive agent preferably having a high heat resistance, is applied to a surface of a core sheet and then a polyolefin film is adhered to the core sheet surface through the adhesive agent layer.

The image-receiving sheet of the present invention preferably has a total thickness of 60 to 400 μm, which is variable in response to the intended use of the sheet.

In an embodiment of the present invention, the image-receiving sheet has a Clark rigidity of 75 to 160 and a Young's modulus of $3\times10^{10}$ to $1\times10^{11}$ dyne/cm$^2$ in the longitudinal direction thereof and can receive clear dye images or pictures even with a very high color density or a very low color density, and exhibits a high resistance to thermal curling and wrinkling.

The Clark stiffness is measured in accordance with JIS P8143 at room temperature, preferably at 20° C.

When the Clark rigidity is less than 75, the resultant image receiving sheet is sometimes easily deformed and thermally curled and exhibits a poor stability of the traveling property in the thermal printer. Also, when the Clark stiffness is more than 160, the resultant image-receiving sheet is sometimes too stiff, and thus exhibits a poor stability of the feed, traveling and delivery thereof and an unsatisfactory close contact with the thermal head and the ink sheet.

When the Young's modulus is within the range of from $3\times10^{10}$ to $1\times10^{11}$ dyne/cm$^2$, the resultant image-receiving sheet can be satisfactorily bent in conformity to a platen roll and a thermal head of a printer, and brought into close contact with the thermal head This property is very effective for forming clear images on the image-receiving sheet at a high reproductivity.

When the Young's modulus is more than $1\times10^{11}$ dyne/cm$^2$2, the resultant image-receiving sheet has too high a resistance to the conformation to the platen roll and thermal head, and accordingly, in the thermal transfer printing operation in which the image-receiving resinous layer surface of the image-receiving sheet comes into direct contact with a dye layer of an ink sheet, the image-receiving resinous layer surface sometimes cannot be smoothly brought into contact with the dye layer surface, and thus irregular gaps are formed between the two surfaces. Therefore, the sublimated dye is indirectly transferred to the image-receiving resinous layer surface through the irregular gaps. This indirect transfer results in a reduction in the amount of the dye received by the image-receiving layer, and therefore, the received images are sometimes uneven and unclear.

The relationship between the Clark stiffness and the Young's modulus is as follows.

$$S=T^3E/12W$$

wherein S represents a Clark stiffness of a sheet, T represents a thickness of the sheet, E represents a Young's modulus of the sheet and W represents a basis weight of the sheet.

In another embodiment of the image-receiving sheet of the present invention, the thickness $D_1$ of the image-receiving resinous layer, the thickness $D_2$ of the front film coating layer formed on the front surface of the core sheet, the thickness $D_3$ of the core sheet and the thickness $D_4$ of the back film coating layer formed on the back surface of the core sheet satisfy the relationships ($I_a$), ($I_b$), and ($I_c$):

$$D_2>D_1 \quad (I_a)$$

$$D_3>D_1 \quad (I_b)$$

and $$D_4\geqq D_2 \quad (I_c)$$

Also, when subjected to a thermal shrinking test at a temperature of 100° C. in accordance with JIS K6734, the thermal shrinkage $S_1$ of the image-receiving resinous layer, the thermal shrinkage $S_2$ of the front film coating layer, the thermal shrinkage $S_3$ of the core sheet and the thermal shrinkage $S_4$ of the back film coating layer satisfy the relationship (II):

$$S_4>S_2\geqq S_3 \quad (II)$$

and preferably the relationships (III*a*) and (III*b*):

$$S_4\cdot D_4>S_1\cdot D_1 \quad (III a)$$

$$S_4\cdot D_4>S_2\cdot D_2 \quad (III b)$$

The thermal shrinking test is carried out at a temperature of 100° C. for 10 minutes, in accordance with JIS K6734.

In the above-mentioned embodiment, the core sheet of the substrate sheet has a thickness $D_3$ of 20 to 300 μm and a thermal shrinkage $S_3$ lower than the thermal shrinkage $S_4$ of the back film coating layer and of 0.1% or less. These features effectively prevent the thermal curling of the resultant image-receiving sheet.

The front film coating layer preferably has a thermal shrinkage $S_2$ of 0.2% or less and smaller than the thermal shrinkage $S_4$ of the back film coating layer.

The low thermal shrinking film can be prepared by bringing it into contact with a heating medium, for example, a heating roll to release stress created in the film by a drawing process applied thereto.

The image-receiving resinous layer comprises the afore-mentioned polymeric material capable of being dyed with sublimating dyes.

The dye-receiving polymer molecules in the image-receiving resinous layer have functional groups, for example, hydroxyl groups, carboxyl groups and/or amino groups.

The functional groups in the dye-receiving polymer molecules may be cross-linked with a polyfunctional cross-linking agent to prevent a thermal fuse-adhesion of the image-receiving resinous layer to the ink sheet.

The cross-linking agent comprises at least one member selected from polyisocyanate compounds, polymethylol compounds and epoxy compounds, and used in an amount of 1 to 20% by weight based on the weight of the dye-receiving polymeric material.

When the amount of the cross-linking agent is less than 1% by weight, the prevention of the fuse-adhesion of the image-receiving resinous layer to the ink sheet is sometimes unsatisfactory.

Also, when the amount of the cross-linking agent is more than 20% by weight, the resultant cross-linked image-receiving resinous layer exhibits a undesirably reduced dye-receiving capability.

To further enhance the fuse-adhesion-preventing effect, the cross-linked image-receiving resinous layer is preferably further added with a member selected from modified silicone resins and silicone oils, for example, amino-modified silicone resins, carboxyl-modified silicone resins, silicone diamines, silicone diols, and silicone dicarboxylic acids.

Usually, the image-receiving resinous layer has a thermal shrinkage $S_1$ of 0.5 to 2.0%. In this case, the back film coating layer preferably has a thermal shrinkage $S_4$ of 0.1 to 1.0%, more preferably 0.3 to 0.5%.

When the thermal shrinkage $S_4$ is less than 0.1%, the resultant image-receiving sheet sometimes thermally curls inward, and when the thermal shrinkage $S_4$ is more than 1.0%, the resultant image-receiving sheet sometimes curls outward.

The image-receiving resinous layer optionally contains an inorganic pigment in an amount of 10% or less based on the total weight of the layer and comprising a member selected from calcium carbonate, clay, sintered clay, zinc oxide, titanium dioxide and silicon dioxide.

Preferably, the image-receiving resinous layer has a weight of 3 to 20 g/m$^2$, more preferably 5 to 15 g/m$^2$.

The image-receiving sheet of the present invention having the above-mentioned specific layered structure has a high resistance to thermal curling and wrinkling and can form clear dye images or pictures having an even hue and color depth which are variable over a wide range. Especially, the porous front film coating layer having a porosity of 33% or more has a small and uniform thermal conductivity, and therefore, is extremely effective for causing the image-receiving resinous layer formed thereon to exhibit a high and uniform dye-receiving sensitivity.

EXAMPLES

The present invention will be further explained with reference to the following examples.

In the examples, the image-receiving properties and the thermal curling property of the resultant image-receiving sheets were tested and evaluated in the following manner.

The image-receiving sheets (dimensions: 120 mm×120 mm) were subjected to a printing operation using a sublimating dye thermal transfer printer available under the trademark of color Video Printer VY-50, from HITACHI LTD.

In the sublimating dye thermal transfer printer, fresh yellow, magenta and cyan dye ink sheets (Trademark: VY-S100, HITACHI LTD.) were used. A thermal head of the printer was heated stepwise at a predetermined heat quantity, and the heat-transferred images were formed in a single color or a mixed (superposed) color provided by superposing yellow, magenta and cyan colored images, on the test sheet. In each printing operation, the clarity (sharpness) of the images, the evenness of shading of the dots, the evenness of shading of close-printed portions, and the resistance of the sheet to thermal curling were observed by the naked eye, and evaluated as follows:

| Class | Evaluation |
|---|---|
| 5 | Excellent |
| 4 | Good |
| 3 | Satisfactory |
| 2 | Not satisfactory |
| 1 | Bad |

Also, the image-receiving sheets were heated at a temperature of 1120° C. for 10 minutes and kept standing at room temperature, and the resistance of the sheet to thermal curling was observed by the naked eye and evaluated in the same manner as mentioned above.

Further, in the examples the polyolefin films for forming the front and back film coating layers of the substrate sheet were prepared as follows.

REFERENCE EXAMPLE 1

Preparation of Polyolefin Film

A resinous blend consisting of 65% by weight of a polypropylene resin with a melt flow index (MI) of 0.8, 15% by weight of a low density polyethylene resin and 20% by weight of calcium carbonate particles having an average size of 1.5 μm was melt-extruded at a temperature of 270° C. through a sheet-forming slit of an extruder, and the melt-extruded sheet-shaped stream of the resinous blend was cooled and solidified by a cooling apparatus, whereby an undrawn polyolefin film was obtained.

The undrawn film was heated at a temperature of 145° C. and drawn at a draw ratio of 5.0 in the longitudinal direction thereof. Then the film was heated at a temperature of 185° C. and then drawn at a draw ratio of 1.5 in the transversal direction thereof.

The front and back surfaces of the biaxially drawn film were activated by a corona discharge treatment.

The resultant film was a single-layered biaxially drawn film having a thickness of 50 μm, a porosity of 36%, an ash content of 20% by weight, a front surface Bekk smoothness of 4000 seconds, an opacity of 81%, and a brightness of 89%.

Referential Example 2

Preparation of Polyolefin Film

A first resinous blend consisting of 80% by weight of a polypropylene resin having a melt flow index (MI) of 0.8 and 20% by weight of calcium carbonate particles having an average size of 1.5 μm was converted to an undrawn film by the same method as mentioned in Referential Example 1.

The resultant undrawn first film was heated at a temperature of 145° C. and then drawn at a draw ratio of 5.0 in the longitudinal direction thereof to prepare a first drawn film.

Separately, a second resinous blend consisting of 45% by weight of a polypropylene resin with a melt flow index (MI) of 4.0, 15% by weight of a low density polyethylene resin and 40% by weight of the same calcium carbonate particles as mentioned above, was melt-kneaded at a temperature of 270° C. in an extruder and extruded through a film-forming die having two slits. The extruded two streams of the melted resinous blend were coated on the front and back surfaces of the first drawn film, and solidified by cooling.

The resultant three layered laminate film was heated at a temperature of 185° C. and then drawn at a draw ratio of 1.5 in the transversal direction thereof. The front and back surfaces of the biaxially drawn three layered film were activated by a corona discharge treatment.

The resultant three layered film had a thickness of 61 μm, a porosity of 40%, an ash content of 30% by weight, a front surface Bekk smoothness of 300 seconds, a degree of opacity of 89%, and a whiteness of 91%.

EXAMPLE 1

A polyethylene terephthalate film available under the trademark of Lumiler S38 from Toray Inc. and having a basis weight of 53 g/m$^2$, a thickness of 38 μm and a thermal shrinkage of 0%, was used as a core sheet.

A single layered polyolefin film prepared in Referential Example 1 was laminated and bonded to a front surface of the core sheet through a polyester adhesive agent to form a front film coating layer.

Also, a multilayer structured film available under the trademark of YUPO FPG60 from OJI YUKA GOSEISHI K.K., comprising a mixture of a polyolefin resin with an inorganic pigment and having a porosity of 25%, a thickness of 60 μm and a thermal shrinkage of 0.5% in the longitudinal direction thereof, was laminated and bonded to a back surface of the core sheet in the same manner as mentioned above, to form a back film coating layer and to provide a substrate sheet.

The surface of the front film coating layer of the substrate sheet was coated with a solution of a polyester resin (which was available under the trademark of VYLON 200 from TOYOBO CO.) in toluene and dried to form an image-receiving resinous layer having a dry weight of 5 g/m$^2$, a thickness of 4.5 μm and a thermal shrinkage of 0.5% in the longitudinal direction thereof.

The resultant image-receiving sheet was subjected to the above-mentioned printing and heating tests.

The test results are shown in Table 1.

EXAMPLE 2

The same procedures as in Example 1 were carried out except that the core sheet consisted of a coated paper sheet available under the trademark of OK COAT from OJI PAPER CO., and having a basis weight of 64 g/m$^2$, a thickness of 56 μm and a thermal shrinkage of 0.01% in the longitudinal direction thereof.

The test results are shown in Table 1.

EXAMPLE 3

The same procedures as in Example 1 were carried out except that the single layered polyolefin film of Referential Example 1 laminated on the front surface of the core sheet was replaced by the three layered polyolefin film of Referential Example 2.

The test results are shown in Table 1.

COMPARATIVE EXAMPLE 1

The same procedures as in Example 1 were carried out except that the single layered polyolefin film laminated on the front surface of the core sheet was replaced by a multilayered polyolefin film available under the trademark of YUPO FPG 60, from OJI YUKA GOSEISHI K.K., and having a thickness of 60 μm, a thermal shrinkage of 0.5% in the longitudinal direction, a porosity of 32%, an ash content of 35% by weight, a front surface Bekk smoothness of 600 seconds, an opacity of 87%, and a brightness of 91%.

The test results are shown in Table 1.

COMPARATIVE EXAMPLE 2

The same procedures as in Comparative Example 1 were carried out except that the core sheet consisted of the same coated paper sheet as mentioned in Example 2.

The test results are shown in Table 1.

EXAMPLE 4

The same polyethylene terephthalate film as mentioned in Example 1 was used as a core sheet.

The same multilayered polyolefin film (YUPO FPG 60) as in Comparative Example 1 was heat treated at a temperature of 90° C. to reduce the thermal shrinkage thereof in the longitudinal direction from 0.5% to 0.2%.

The heat treated polyolefin film had a porosity of 32% and a thickness of 60 μm.

The heat treated polyolefin film (YUPO FPG 60) was laminated on the front surface of the core sheet and the non-heat treated polyolefin film (YUPO FPG 60) was laminated on the back surface of the core sheet in the same manner as in Example 1, to provide a substrate sheet.

Tho same polyester resin (VYLON 200) solution as in Example 1 was coated on the front film coating layer surface of the substrate sheet to form an image-receiving resinous layer having a weight of 5 g/m$^2$, a thickness of 4.5 μm, and a thermal shrinkage of 0.5% in the longitudinal direction thereof.

The resultant image-receiving sheet had a Clark rigidity of 80 and a Young's modulus of $4\times10^{10}$ dyne/cm$^2$ in the longitudinal direction thereof at a temperature of 20° C.

The image-receiving sheet was subjected to the same tests as mentioned above, except that the Color Video Printer VY-50 was replaced by a color video printer available under the trademark of UP-5000 from SONY CORPORATION, and the traveling property of the sheet in the printer was observed and evaluated in the same manner as mentioned above.

The test results are shown in Table 1.

EXAMPLE 5

The same procedures as in Example 4 were carried out except that the core sheet consisted of a coated paper sheet (available under the trademark of OK COAT 72 from OJI PAPER CO.) having a thickness of 62 μm a thermal shrinkage of 0.01% in the longitudinal direction thereof and a basis weight of 72.3 g/m$^2$ and each of the front and back surfaces of the core sheet was laminated by a multilayered polyolefin film available under the trademark of YUPO FPG 60 from OJI YUKA GOSEISHI K.K. and having a porosity of 33%, a thickness of 60 μm and a thermal longitudinal shrinkage of 0.5%, in the same manner as in Example 1, to provide a substrate sheet.

The same image-receiving resinous layer as in Example 1 was formed on the front film coating layer surface of the substrate sheet.

The resultant image-receiving sheet had a Clark stiffness of 150 and a Young's modulus of $5\times10^{10}$ dyne/cm$^2$ at 20° C.

The test results are shown in Table 1.

COMPARATIVE EXAMPLE 3

The same procedures as in Example 4 were carried out except that the substrate sheet consisted of a multilayered polyolefin film available under the trademark of YUPO FPG 150, from OJI YUKA GOSEISHI K.K. and having a thickness of 150 μm, alone.

The resultant comparative image-receiving sheet had a Clark rigidity of 70 and $2.9\times10^{10}$ dyne/cm$^2$ in the longitudinal direction thereof at 20° C.

The test results are shown in Table 1.

COMPARATIVE EXAMPLE 4

The same procedures as in Example 4 were carried out except that the substrate sheet consisted of a biaxially oriented polyester film available under the trademark of MELINEX 329, from ICI and having a thickness of 100 μm.

The resultant comparative image-receiving sheet had a Clark rigidity of 65 and a Young's modulus of $1.1\times10^{11}$ dyne/cm$^2$ in the longitudinal direction thereof at 20° C.

The test results are shown in Table 1.

EXAMPLE 6

A fine paper sheet available under the trademark of OK FORM PAPER from OJI PAPER CO., and having a basis weight of 64 g/m$^2$, a thickness ($D_3$) of 56 μm and a thermal longitudinal shrinkage ($S_3$) of 0.01% was employed as a core sheet.

The same multilayered polyolefin film (YUPO FPG 80) as mentioned in Example 1 was heat treated at 80° C. for hours. The resultant heat-treated film had a porosity of 25%, a thermal longitudinal shrinkage of 0.2% and a thickness of 80 μm.

This heat-treated film was laminated on the front surface of the core sheet to form a front film coating layer, and a non-heat treated film was laminated on the back surface of the core sheet to form a back film coating layer in the same manner as in Example 1, to provide a substrate sheet.

The front film coating layer surface of the substrate sheet was coated with a solution of 100 parts by weight of the same polyester resin (VYLON 200) as mentioned in Example 1 and 8 parts by weight of a polyisocyanate compound available under the trademark of CORONATE L from NIHON POLYURETHANE KOGYO K.K. in a mixture of 400 parts by weight of toluene with 100 parts by weight of methylethylketone and dried to form an image-receiving resinous layer having a weight of 5 g/m$^2$, a thickness ($D_1$) of 4.5 μm and a thermal longitudinal shrinkage $S_1$ of 0.5%, to provide an image-receiving sheet.

The thicknesses $D_1$ to $D_4$ and thermal longitudinal shrinkages $S_1$ to $S_4$ of each layer and the test results are shown in Table 1.

EXAMPLE 7

The same procedures as in Example 6 were carried out except that the fine paper sheet used as a core sheet was replaced by a coated paper sheet having a weight of 72 g/m$^2$, a thickness ($D_3$) of 60 μm and a thermal longitudinal shrinkage ($S_3$) of 0.01%.

The test results are shown in Table 1.

EXAMPLE 8

The same procedures as in Example 6 were carried out with the following exceptions.

The core sheet consisted of a coated paper sheet having a basis weight of 64 g/m$^2$, a thickness ($D_3$) of 56 μm and a thermal longitudinal shrinkage ($S_3$) of 0.01%.

In the formation of the front film coating layer, the same multilayered polyolefin film (YUPO FPG 60) as mentioned in Comparative Example 1 was heat treated at a temperature of 90° C. for 24 hours to provide a heat-treated film having a thermal longitudinal shrinkage of 0.08% and a thickness of 59 μm and porosity of 32%, and the heat treated film was laminated on the front surface of the core sheet.

In the formation of the back film coating layer, the same multi-layered polyolefin film (YUPO FPG 60) as mentioned above was heat-treated at a temperature of 75° C. for 24 hours and the resultant heat-treated film having a porosity of 33%, a thickness ($D_4$) of 60 μm and a thermal longitudinal shrinkage ($S_4$) of 0.01% was laminated on the back surface of the core sheet.

The front surface of the resultant substrate sheet was coated with the same image-receiving resinous layer as in Example 6.

The test results are indicated in Table 1.

EXAMPLE 9

The same procedures as in Example 6 were carried out except that the polyester resin (VYLON 200) was replaced by another polyester resin available under the trademark of POLYESTRE KA 1051T from ARAKAWA KAGAKU K.K. The resultant image-receiving resinous layer had a thermal longitudinal shrinkage ($S_1$) of 0.7%.

The test results are shown in Table 1.

COMPARATIVE EXAMPLE 5

The same procedures as in Example 6 were carried out except that the multi-layered polyolefin films (YUPO FPG 80) for the front and back film coating layers were not heat-treated.

The test results are shown in Table 1.

COMPARATIVE EXAMPLE 6

The same procedures as in Example 6 were carried out except that the substrate sheet consisted of a polypropylene film (CPP film) having a thickness of 70 μm, a thermal longitudinal shrinkage of 0.5% and a porosity of 0%, alone.

The test results are indicated in Table 1.

COMPARATIVE EXAMPLE 7

The same procedures as in Example 6 were carried out except that the substrate sheet consisted of a biaxially oriented multilayered polyolefin film available under the trademark of YUPO FPG 150, from OJI YUKA GOSEISHI K.K., comprising a polypropylene resin and calcium carbonate particles, and having a thickness of 150 μm, a thermal longitudinal shrinkage of 0.5% and a porosity of 27%, alone.

The test results are shown in Table 1.

TABLE 1

| Item | Thickness (μm) | | | | Thermal longitudinal shrinkage (%) | | | | Product of shrinkage and thickness | | | Colored image | | Resistance to curing | |
|---|---|---|---|---|---|---|---|---|---|---|---|---|---|---|---|
| Example No. | $D_1$ | $D_2$ | $D_3$ | $D_4$ | $S_1$ | $S_2$ | $S_3$ | $S_4$ | $S_1.D_1$ | $S_2.D_2$ | $S_4.D_4$ | Clarity(*)1 | Uniformity | Printing test | Heating test |
| Example | | | | | | | | | | | | | | | |
| 1 | 4.5 | 50 | 38 | 60 | 0.5 | 0.5 | 0.03 | 0.5 | 0.23 | 25 | 30 | 4 | 5 | 4 | — |
| 2 | 4.5 | 50 | 56 | 60 | 0.5 | 0.5 | 0.01 | 0.5 | 0.23 | 25 | 30 | 4 | 5 | 5 | — |
| 3 | 4.5 | 61 | 38 | 80 | 0.5 | 0.5 | 0.03 | 0.5 | 0.23 | 30 | 40 | 5 | 4 | 4 | — |
| 4 | 4.5 | 60 | 38 | 60 | 0.5 | 0.2 | 0.03 | 0.5 | 0.23 | 12 | 30 | 4 | 5 | 5 | — |
| 5 | 4.5 | 60 | 62 | 60 | 0.5 | 0.2 | 0.01 | 0.5 | 0.23 | 12 | 30 | 4 | 5 | 5 | — |
| 6 | 4.5 | 80 | 56 | 80 | 0.5 | 0.2 | 0.01 | 0.5 | 0.23 | 16 | 40 | 4 | 4 | 4 | 5 |
| 7 | 4.5 | 80 | 60 | 80 | 0.5 | 0.2 | 0.01 | 0.5 | 0.23 | 16 | 40 | 5 | 5 | 5 | 4 |
| 8 | 4.5 | 59 | 56 | 60 | 0.5 | 0.08 | 0.01 | 0.35 | 0.23 | 0.5 | 20 | 5 | 5 | 5 | 4 |
| 9 | 4.5 | 80 | 56 | 80 | 0.7 | 0.2 | 0.01 | 0.5 | 0.31 | 16 | 40 | 4 | 4 | 4 | 4 |
| Comparative Example | | | | | | | | | | | | | | | |

TABLE 1-continued

| Item | Thickness (μm) | | | | Thermal longitudinal shrinkage (%) | | | | Product of shrinkage and thickness | | | Colored image | | Resistance to curing | |
|---|---|---|---|---|---|---|---|---|---|---|---|---|---|---|---|
| Example No. | $D_1$ | $D_2$ | $D_3$ | $D_4$ | $S_1$ | $S_2$ | $S_3$ | $S_4$ | $S_1 \cdot D_1$ | $S_2 \cdot D_2$ | $S_4 \cdot D_4$ | Clarity(*)1 | Uniformity | Printing test | Heating test |
| 1 | 4.5 | 60 | 38 | 60 | 0.5 | 0.5 | 0.03 | 0.5 | 0.23 | 30 | 30 | 3 | 3 | 4 | — |
| 2 | 4.5 | 60 | 56 | 60 | 0.5 | 0.5 | 0.01 | 0.5 | 0.23 | 30 | 30 | 2 | 2 | 5 | — |
| 3 | 4.5 | 0 | 150 | 0 | 0.5 | — | — | — | — | — | — | 4 | 5 | 2(*)3 | — |
| 4 | 4.5 | 0 | 100 | 0 | 0.5 | — | — | — | — | — | — | 3 | 2(*)2 | 2 | — |
| 5 | 4.5 | 80 | 56 | 80 | 0.5 | 0.5 | 0.01 | 0.5 | — | — | — | 5 | 5 | 2 | 2 |
| 6 | 4.5 | 0 | 70 | 0 | 0.5 | — | — | — | — | — | — | 3 | 3 | 2 | 2 |
| 7 | 4.5 | 0 | 150 | 0 | 0.5 | — | — | — | — | — | — | 5 | 5 | 1 | 1 |

Note:
(*)1Optical density
(*)2The images became partly blurred.
(*)3Wrinkles were generated.

We claim:

1. A thermal transfer image-receiving sheet comprising:

(A) a substrate sheet comprising (a) a core sheet having a thickness of 10 to 300 μm, and (b) at least one film coating layer formed on at least a front surface of the core sheet, comprising as a principal component, a mixture of a polyolefin resin with an inorganic pigment and having a porosity of 33% or more and a thickness of 20 μm or more; and (B) at least one image-receiving resinous layer formed on at least the front film coating layer of the substrate sheet, comprising a polymeric material capable of being dyed with dyes and having a thickness of 10 μm or less.

2. The image-receiving sheet as claimed in claim 1, wherein the film coating layer comprises a member selected from drawn single layered and multi-layered, polymeric films.

3. The image-receiving sheet as claimed in claim 1, wherein the film coating layer comprises 40 to 90% by weight of a polypropylene resin, 5 to 30% by weight of a high density polyethylene resin and 5 to 40% by weight of an inorganic pigment.

4. The image-receiving sheet as claimed in claim 1, wherein the inorganic pigment comprises at least one member selected from ground and precipitated calcium carbonates, sintered clay, diatomaceous earth, talc, titanium dioxide, silica and aluminum sulfate having an average particle size of 20 μm or less.

5. The image-receiving sheet as claimed in claim 1, wherein the film coating layer has a porosity of 36% or more.

6. The dye image-receiving sheet as claimed in claim 1, wherein the film coating layer has a thickness of 30 to 80 μm.

7. The image-receiving sheet as claimed in claim 1, wherein the core sheet comprises a member selected from fine paper sheets, middle grade paper sheets, Japanese paper sheets, polyester films, polyolefin films, polyamide films and composite sheets composed of two or more of the above-mentioned sheets and films.

8. The image-receiving sheet as claimed in claim 1, wherein the image-receiving resinous layer comprises at least one member selected from saturated polyester resins comprising a polymerization product of a saturated aromatic dicarboxylic acid component comprising at least one member selected from orthophibulic acid, isophthalic acid, terephthalic acid, adipic acid and sebacic acid, with a polyol component comprising at least one member selected from ethylene glycol, propylene glycol and addition reaction products of bisphenol A with ethylene glycol; epoxy resins; cellulosic resins and polyamide resins which can be dyed with sublimating dyes.

9. The image-receiving sheet as claimed in claim 1, which has a Clark rigidity of 75 to 160 and a Young's modulus of $3\times10^{10}$ to $1\times10^{11}$ dyne/cm$^2$ in the longitudinal direction thereof.

10. The image-receiving sheet as claimed in claim 1, wherein the thickness $D_1$ of the image-receiving resinous layer, the thickness $D_2$ of the film coating layer formed on the front surface of the core sheet, the thickness $D_3$ of the core sheet and the thickness $D_4$ of the film coating layer formed on a back surface of the core sheet satisfy the relationships ($I_a$), ($I_b$) and ($I_c$):

$$D_2 > D_1 \quad (I_a)$$

$$D_3 > D_1 \quad (I_b)$$

and $$D_4 \geqq D_2 \quad (I_c)$$

and in a thermal shrinking test at a temperature of 100° C. in accordance with Japanese Industrial Standard K 6734, the thermal shrinkage $S_2$ of the front film coating layer, the thermal shrinkage $S_3$ of the core sheet and the thermal shrinkage $S_4$ of the back film coating layer satisfy the relationship (II):

$$S_4 > S_2 \geqq S_3 \quad (II)$$

11. The image-receiving sheet as claimed in claim 10, wherein the thickness $D_1$, $D_2$ and $D_4$ as defined above, the thermal shrinkage $S_1$ of the image-receiving resinous layer and the thermal shrinkages $S_2$ and $S_4$ as defined above satisfy the relationships (III*a*) and (III*b*):

$$S_4 \cdot D_4 > S_1 \cdot D_1 \quad (III a)$$

and $$S_4 \cdot D_4 > S_2 \cdot D_2 \quad (III b)$$

12. The image-receiving sheet as claimed in claim 10, wherein the thermal shrinkage $S_4$ of the back film coating layer is 0.1 to 1.0%.

13. The image-receiving sheet as claimed in claim 1, wherein the core sheet is selected from thin paper sheets.

14. The image-receiving sheet as claimed in claim 1, wherein the core sheet is selected from coated paper sheets.

* * * * *